United States Patent [19]

Hale

[11] Patent Number: 4,651,346

[45] Date of Patent: Mar. 24, 1987

[54] LAP HUGGER

[76] Inventor: Shirley A. Hale, 4404 Old Pewter Cir., Virginia Beach, Va. 23455

[21] Appl. No.: 852,263

[22] Filed: Apr. 15, 1986

[51] Int. Cl.[4] ..... A41D 27/12

[52] U.S. Cl. ..... 2/46; 2/69

[58] Field of Search ..... 2/49, 46, 69, 69.5

[56] References Cited

U.S. PATENT DOCUMENTS

| | | | |
|---|---|---|---|
| 1,554,692 | 9/1925 | Shane | 2/69 |
| 2,886,822 | 5/1959 | Matthews | 2/114 |
| 3,085,248 | 4/1963 | Benson | 2/46 |
| 3,144,659 | 8/1964 | Matthews | 2/83 |
| 4,363,141 | 12/1982 | Doster | 2/69.5 |
| 4,383,335 | 5/1983 | Slocum | 2/114 |

*Primary Examiner*—Doris L. Troutman

*Attorney, Agent, or Firm*—Griffin, Branigan & Butler

[57] ABSTRACT

A garment (10) to be worn by an incontinent, sedentary person includes a front sheet (12) for covering the front of the person from the waist to below the knees, and a backsheet (14) sewn to the back, lower end of the front sheet along three seams parallel with the length of the front sheet to provide wide, loose leg sleeves (24,26) through which the person's legs are extended. A tie string (16) extends across the top of the front sheet for tying the top of the front sheet about the waist of the person. The leg sleeves and the tie string hold the garment on the person to thereby prevent exposure of the front of the person's abdominal region and legs but yet the front sheet leaves a gap at the rear of the person for allowing passage of body waste from the person without soiling the garment.

6 Claims, 5 Drawing Figures

LAP HUGGER

BACKGROUND OF THE INVENTION

This invention relates broadly to robes, or drapes for disabled patients, and more particularly to such drapes which are to be worn by incontinent patients who spend much time in sitting or lying positions.

In many hospitals, nursing homes, and the like, there are a number of incontinent patients who spend much time in wheelchairs, especially among older patients. Many such patients are paralyzed because of accidents or other sicknesses but yet are mentally quite alert so they are fully conscious of their bodies, but yet have difficulty caring for them. In caring for such patients, hospital and nursing home staff members have found it to be convenient to place absorbent pads, or other such receivers of body wastes, on chairs on which the patients sit and to periodically replace or empty these receivers. Such arrangements are superior to using "diaper"-like absorbers worn by patients under normal clothes because many of these patients cannot dress and undress themselves and it is quite difficult and burdensome for staff members to dress and undress patients to replace absorbers. When a chair "receiver" has been used in the prior art, it has been customary to place a sheet, blanket, or other drape on the front of the patient so that the patient is not embarrassingly, and unwillingly "exposed".

A major problem with prior-art cover sheets is that these sheets will often move to one side or the other, or simply fall down, thereby exposing the patient. In this respect, sometimes sudden movements by patients will cause such exposure but in other cases, where patient's cannot use their arms and/or hands, to readjust the sheets, they will fall down slowly over a longer period of time. Also, some patients are mentally disturbed and do not care if they are exposed. It is an object of this invention to provide a drape which allows a body-waste receiver to be used with a wheelchair, normal chair, or other patient support, but yet which does not normally allow the patient to become "exposed" below the waist.

A number of hospital gowns, and robes have been suggested for incontinent individuals, some of these are described in U.S. Pat. Nos. 4,383,335 to Slocum, 2,886,822 to Matthews and 3,144,659 to Matthews. However, a difficulty with these gowns is that they are quite confining for patients and/or are difficult, both for patients and care staff members, to put on and take off the patients. It is an object of this invention to provide a drape to be worn by an incontinent patient which is extremely easy to put on and take off the patient, but yet which provides protection from "exposure" for the patient while allowing the use of chair body-waste absorbers or other receivers. Still another problem with these gowns is that they are rather unsightly in appearance, forcing the patient to appear fully clothed in a hospital-like garment. Thus, it is another object of this invention to provide a drape to be worn by incontinent patients which allows them to wear personalized garments on their upper bodies which do not have a "hospital" appearance.

It is yet another object of this invention to provide a garment to be worn by incontinent persons which is uncomplicated in structure, inexpensive to fabricate, easy to put on and take off a patient, pleasing in appearance, and which allows the patient the upmost freedom of movement and security from exposure.

SUMMARY

According to principles of this invention, a garment to be worn by incontinent persons comprises an elongated front sheet with a shorter backsheet attached to the lower end, back side, of the front sheet along side and middle parallel seams running parallel to the length of the front sheet for forming leg sleeves between the front and back sheets. A tie is located at the top end of the front sheet for wrapping the top end of the front sheet about the waist of a patient, however, leaving a gap between site edges of the top sheet at the rear of the patient. To put this garment on a patient, the legs of the patient are first inserted through the leg sleeves with the front sheet on the fronts of the legs and the back sheet on the backs of the legs and then the tie is tied about the person's waist.

BRIEF DESCRIPTION OF THE DRAWINGS

The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
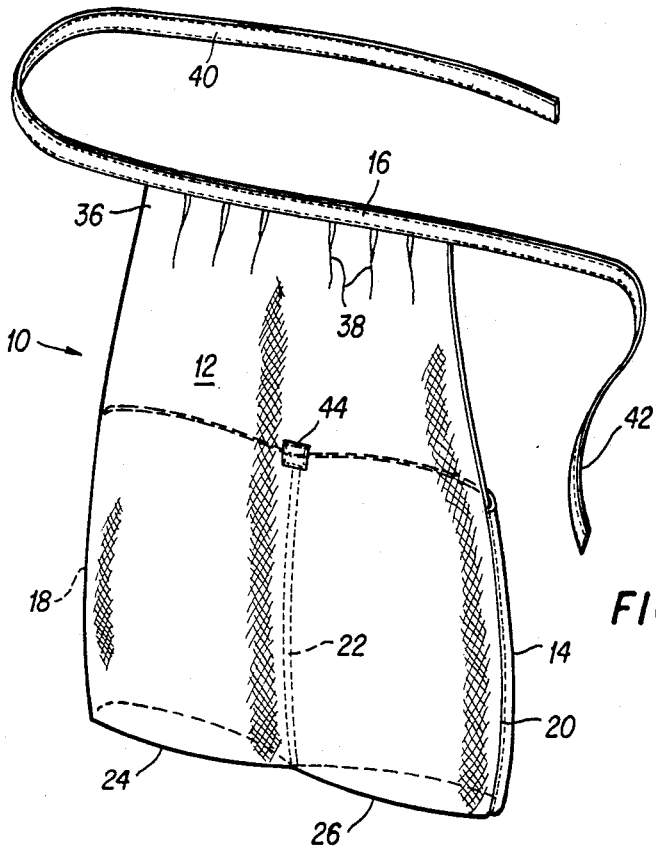
FIG. 1 is a front view of a garment embodying principles of this invention.
Figure 2:
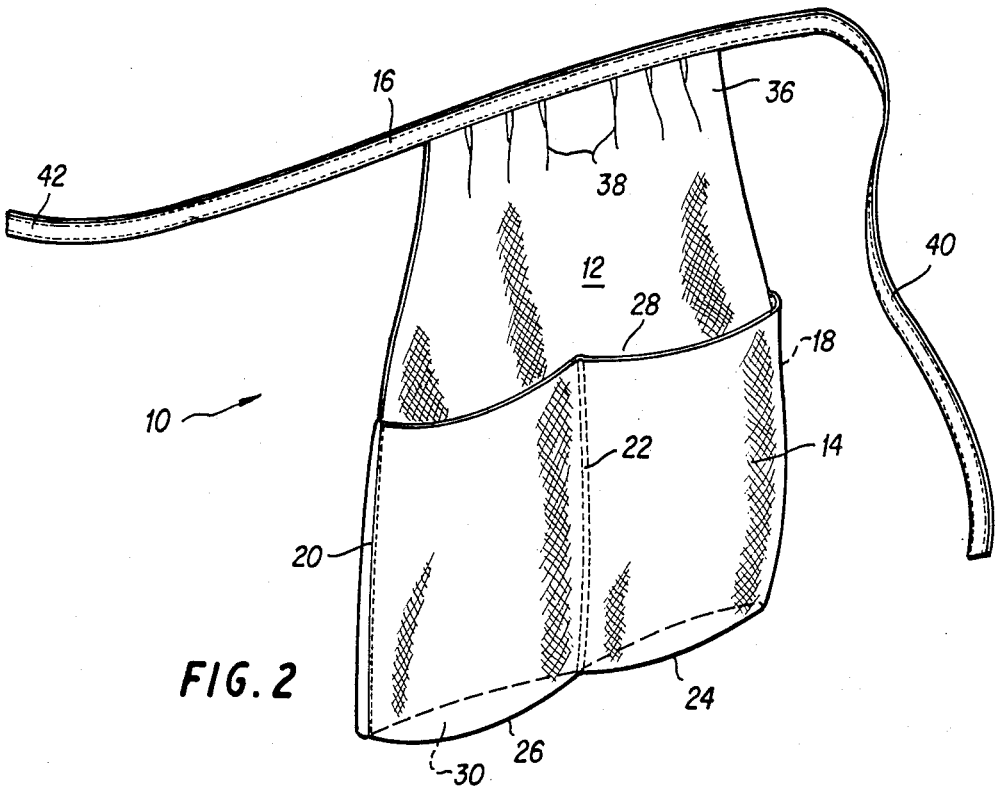
FIG. 2 is a rear, isometric view of the garment of FIG. 1.
Figure 3:
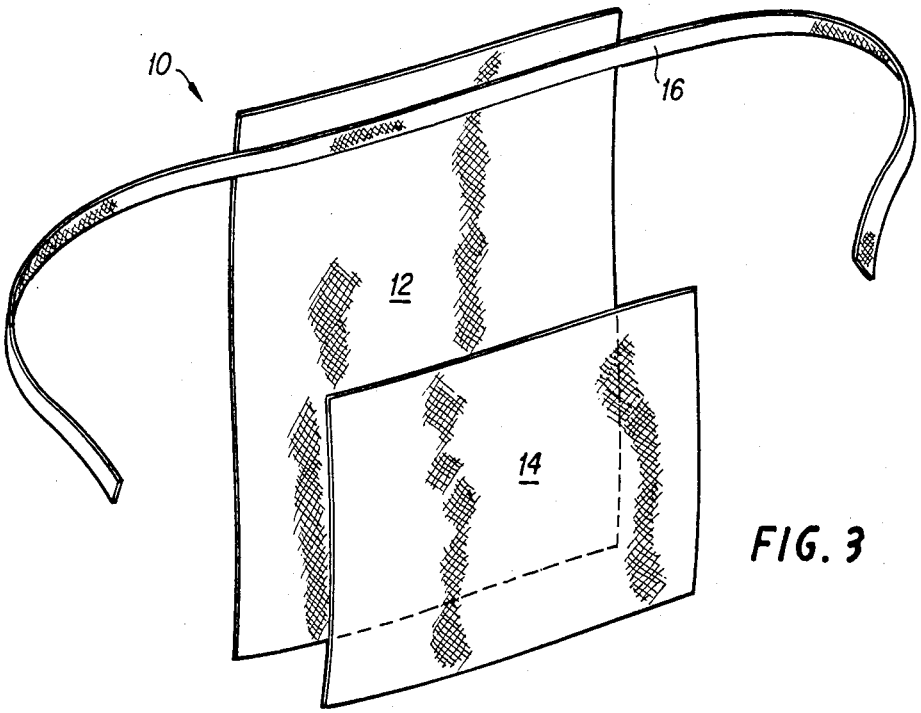
FIG. 3 is an exploded isometric view of the three main elements making up the garment of FIGS. 1 and 2.
Figure 4:
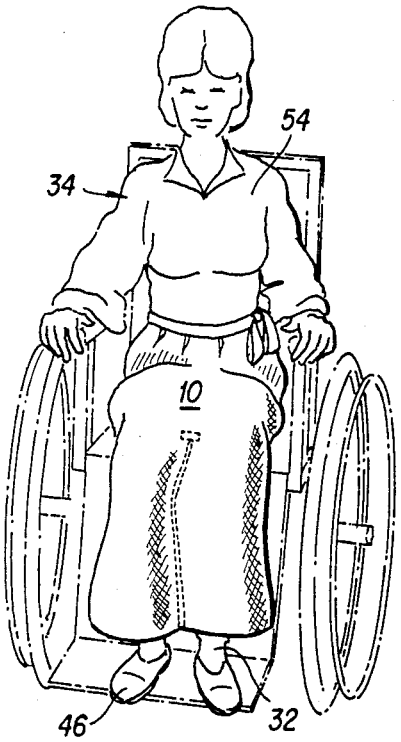
FIG. 4 is an isometric, front view of a person wearing the garment of FIGS. 1 and 2 sitting in a schematically represented wheelchair; and, FIG. 5 is an isometric rear view of a person wearing the garment of FIGS. 1 and 2 in a sitting position, but with the sitting support not being shown.

A garment 10 to be worn by an incontinent, sedentary person basically comprises a front sheet 12, a backsheet 14, and a tie string 16.

The front sheet 12, in a preferred embodiment, is a rectangular cotton sheet measuring about 50 inches long (from top to bottom) and approximately 40 inches wide. The 50 inch length of the front sheet allows the garment to be used with a wide size-range of individuals.

The backsheet 14 is also a cotton, rectangular-in-shape, sheet, and in a preferred embodiment, is approximately 25 inches tall (from top to bottom) and 40 inches wide. In this respect, the back sheet should be at least 12 inches tall, however, it has been found that about a 25 inch dimension is best to fit a wide range of patient sizes.

The tie string 16 is approximately 79 to 80 inches long and is constructed of cotton sheet doubled over and sewn onto itself so as to be stronger than a single ply of sheet material.

In the preferred embodiment, all three parts, the front sheet 12, the backsheet 14, and the tie string 16, are constructed of a cotton, or cotton mix, material much like be d sheet material, however, it should be understood that other materials and mixtures of materials could be used. Prior to assembling the front sheet 12 and backsheet 14, they are appropriately hemmed. The backsheet 14 is then placed with its lower edge and two side edges at the respective lower edge and side edges of the front sheet 12 and the front and back-sheets 12 and 14 are then sewn together along parallel edge seam lines 18 and 20 and an intermediate seam line 22. Thus, wide, loose, right and left leg sleeves 24 and 26 are formed, each having top and bottom openings 28 and 30 therein for receiving legs 32 of a patient 34. The intermediate seam line 22 is approximately halfway between the edge seam lines 18 and 20.

A top end 36 of the front sheet 12 is uniformly gathered across its width at gather folds 38 to make the top end 36 about 28 inches wide and this top end is then sewn, off center of the cloth tie string 16, to the cloth tie string 16 so as to leave a 34 inch first end 40 of the tie string 16 (that is, extending 34 inches from the side edge of the front sheet 12) and a 17 inch second end 42 of the tie string 16.

In the preferred embodiment, in order to provide extra strength to the garment, a small support tab 44 is sewn at the front side of the front sheet 12 at the top of the intermediate seam line 22 onto the top and back-sheets 14. In this respect, when it is being used, a great deal of force is often applied to the top end of this intermediate seam and this support tab 44 prevents the front sheet from prematurely ripping at this point.

Figure 5:
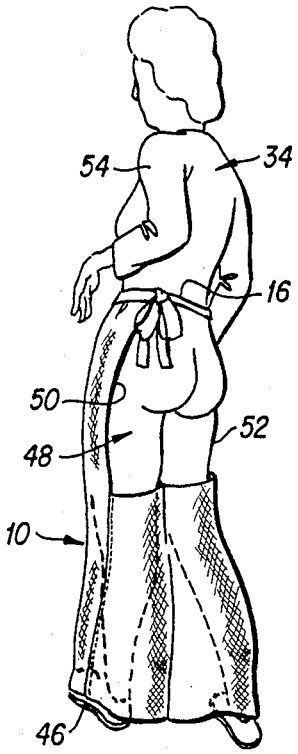

In use, a patient's right and left feet and legs are respectively inserted through the wide, loose right and left leg sleeves 24 and 26 from their top ends 28 so that feet 46 of the patient 34 extend from the bottoms of the sleeves 24 and 26. The first end 40 of the tie string 16 is then pulled around the back of the patient 34, as depicted in FIG. 5 and tied to the second end 42 of the tie string 16 on the left side of the patient. A gap 48 is left between side edges 50 and 52 of the front sheet 12 at the abdomen area of the patient 34 so as to allow passage of body waste from the patient without soiling the garment 10. Thus, an absorbent or other receiver can be placed in this area between the patient and a seat of a chair for receiving body waste. For most patients the bottom end of the garment 10 will fall on the tops of the patient's shoes, however, for all patients the bottom hem of the garment will be between the patient's knees and shoes.

The garment 10 is to be worn with a separate, normal "civilian" top 54 of the patient's or staff's choosing.

It will be appreciated by those skilled in the art that the garment 10 can be quickly applied to an individual by pulling it over his legs, while he is wearing shoes, which necessitates only the lifting his legs and not his entire body. The second end of the tie string is then brought about the patient's back and tied at the patient's left side. By having the tie at the side a care giver can easily slip the tie string about the patient's back and can then adjust the knot where it is visible. Also, this arrangement does not create a knot behind the patient which could be uncomfortable. Still further, when the patient has the use of his arms and hands, he or she can reach the tie for making these adjustments. This garment remains extremely loose, and is thereby non-restraining to a patient. However, because of the wide, loose leg sleeves 24 and 26, the garment remains in place on the patient's lap with only a minimal of maintenance by the patient and/or staff members to ensure that the dignity and privacy of the patient are maintained.

This garment is appropriate for individuals with limited control or paralysis of lower extremities, and are therefore incontinent. The garment is for those who cannot wear conventional clothing below the waist.

It will be appreciate by those skilled in the art that by allowing a patient to wear a conventional top, the garment maintains a more casual, every-day appearance and thereby contributes to the dignity and self esteem of the patient. Further, if the garment had arm sleeves, it would be much more difficult to dress the patient, or for the patient to dress him or herself, than with the tie string of this invention.

The wide bottom openings 30 of the right and left leg sleeves 24 and 26 not only make it easy to dress a patient but also provide easy, loose access for staff to observe the condition of a patient's feet and legs and to perform treatments without removing the garment.

In addition, the right and left leg sleeves 24 and 26 protect against damage to skin caused by legs rubbing against each other due to restlessness or constant movement of the patient. Further, these leg sleeves prevent the legs from coming into direct contact with sides or arms of chairs or other rough surfaces. This garment can be worn in a traychair, geriatric recliner or a wheelchair. The garment also allows a patient to wear any footware desired.

While the invention has been particularly shown and described with reference to a preferred embodiment it will be understood by those skilled in the art that various changes in form and detail may be made therein without departing from the spirit and scope of the invention. For example, the front and back sheets could be made of a combination of cotton with a synthetic or many other materials. A flannel garment could be used in the winter time.

The embodiment of the invention in which an exclusive property or privilege are claimed are defined as follows:

1. A garment to be worn by incontinent, sedentary, persons comprising:

a cloth front sheet having a length for extending at least from a person's waist to substantially below the person's knees and having a width for extending substantially about the waist of the person, but not extending completely about the person's waist so as to leave a substantial gap between side edges thereof when the front sheet is wrapped about the person's body;

a fastening means attached to the top end of said front sheet for fastening the top end of said front sheet at or above the waist of said person and allowing said front sheet to drape downwardly from the person's waist to easily cover the fronts of the abdominal region, the thighs, and the knees of the person; and, a cloth back sheet attached to the backside, at the bottom end, of said front sheet along three attachment lines running approximately parallel with the length of said front sheet, two of said lines being side attachment lines located at opposite side edges of the front and back-sheets where said respective front sheet side edges are attached to the corresponding backsheet side edges, and the third attachment line being an intermediate attachment line located between the side attachment lines, thereby forming two wide, loose side-by-side leg sleeves each for allowing a foot and a leg of said person to easily pass therethrough and thereby holding said front sheet on the front of said person's abdominal area and legs to prevent these portions of the body from being exposed, but yet allowing the person leg movement within the garment, and leaving said gap opening for allowing passage for body waste from said person without soiling said garment.

2. A garment as in claim 1, wherein said fastening means is a string tie for wrapping about the waist of said person and tying therearound.

3. A garment as in claim 2, wherein said backsheet is at least one foot tall (from top to bottom).

4. A garment as in claim 3, wherein said front and backsheets are around 40 inches wide, with said front sheet being approximately 50 inches long (from top to bottom).

5. A garment as in claim 3, wherein is further included a support tab sewn to said front and backsheets at the top end of said intermediate seam for providing extra strength at said top end.

6. A garment as in claim 2, wherein said tie string is longer on one side edge of said front sheet than on the other side edge of said front sheet.

* * * * *